US009322338B2

(12) United States Patent
Ma et al.

(10) Patent No.: US 9,322,338 B2
(45) Date of Patent: Apr. 26, 2016

(54) THROTTLE VALVE FOR PREVENTING SUDDEN UNINTENDED ACCELERATION

(71) Applicants: Sang Yeoul Ma, Seoul (KR); Myong Im Yu, Anyang-si (KR)

(72) Inventors: Sang Yeoul Ma, Seoul (KR); Myong Im Yu, Anyang-si (KR)

( * ) Notice: Subject to any disclaimer, the term of this patent is extended or adjusted under 35 U.S.C. 154(b) by 0 days.

(21) Appl. No.: 14/000,831

(22) PCT Filed: Jan. 23, 2013

(86) PCT No.: PCT/KR2013/000525

§ 371 (c)(1),
(2) Date: Aug. 21, 2013

(87) PCT Pub. No.: WO2014/106965

PCT Pub. Date: Jul. 10, 2014

(65) Prior Publication Data

US 2015/0300267 A1 Oct. 22, 2015

(30) Foreign Application Priority Data

Jan. 7, 2013 (KR) ..... 10-2013-0001794

(51) Int. Cl.
*F02D 9/10* (2006.01)
*F02M 35/10* (2006.01)
(Continued)

(52) U.S. Cl.
CPC *F02D 9/10* (2013.01); *F02D 9/103* (2013.01); *F02D 9/109* (2013.01); *F02D 9/1025* (2013.01);
(Continued)

(58) Field of Classification Search
CPC ..... F02D 9/10
USPC ..... 251/175; 137/601.08, 601.11, 625.3, 137/625.31, 512.1, 512.5, 479, 482, 484, 137/565.13
See application file for complete search history.

(56) References Cited

U.S. PATENT DOCUMENTS 6,557,826 B2 * 5/2003 Moore ..... F16K 1/223 137/601.11
7,011,292 B1 * 3/2006 Hill ..... B65B 39/003 137/601.11
(Continued)

FOREIGN PATENT DOCUMENTS

EP 0845585 6/1998
GB 1058431 A * 2/1967 ..... F02M 9/103
(Continued)

OTHER PUBLICATIONS

International Search Report for International Application No. PCT/KR2013/000525, dated Jun. 11, 2013.
(Continued)

*Primary Examiner* — John K Fristoe, Jr.
*Assistant Examiner* — Paul Gray
(74) *Attorney, Agent, or Firm* — Kile Park Reed & Houtteman PLLC

(57) ABSTRACT

A throttle valve for preventing a sudden unintended acceleration, the throttle valve regulating an amount of air supplied to an engine mounted on a vehicle and including a valve main body, a flow path formed in the valve main body and having an inlet through which the air flows in and an outlet connected to the engine, and a flow rate regulating unit regulating an amount of the air in the flow path by opening or closing the flow path, in which, when a rapid pressure drop occurs at the outlet side connected to the engine, the flow rate regulating unit is pressed by a force generated due to a difference in pressure between the inlet and the outlet so as to close the flow path without use of an additional drive source. When a rapid pressure drop occurs at the outlet side connected to the engine, a flow rate regulating unit automatically closes the flow path without use of an additional drive source by being pressed by a force generated due to a difference in pressure between the inlet and the outlet, thereby substantially preventing a vehicle sudden unintended acceleration accident.

7 Claims, 8 Drawing Sheets

(51) Int. Cl.

| | |
|---|---|
| ***F02D 9/12*** | (2006.01) |
| *F02D 11/04* | (2006.01) |
| *F02D 9/02* | (2006.01) |

(52) U.S. Cl.

CPC ..... *F02D 9/12* (2013.01); *F02M 35/10295* (2013.01); *F02D 11/04* (2013.01); *F02D 2009/0284* (2013.01)

(56) References Cited

U.S. PATENT DOCUMENTS

| | | | | |
|---|---|---|---|---|
| 7,931,452 | B2 * | 4/2011 | Hibino | F04B 27/1018 137/493.9 |
| 2003/0047703 | A1 * | 3/2003 | Patterson | F02D 9/08 251/301 |
| 2009/0056671 | A1 * | 3/2009 | Matsuura | F02D 9/10 123/337 |
| 2010/0119356 | A1 * | 5/2010 | Fintescu | F01D 9/065 415/47 |
| 2013/0199176 | A1 * | 8/2013 | Cattani | F02B 37/025 60/602 |

FOREIGN PATENT DOCUMENTS

| | | | |
|---|---|---|---|
| JP | 7-246856 | 9/1995 | |
| JP | 2005-171888 | 6/2005 | |
| JP | 2009-540192 | 11/2009 | |
| KR | 1997-0044705 | 7/1997 | |
| KR | 1998-072674 | 11/1998 | |
| KR | 20-1999-0026504 | 7/1999 | |
| WO | WO 2008002334 A2 * | 1/2008 | F02D 9/02 |

OTHER PUBLICATIONS

PCT Written Opinion of the International Searching Authority for International Application No. PCT/KR2013/000525, dated Jan. 23, 2013.

* cited by examiner

THROTTLE VALVE FOR PREVENTING SUDDEN UNINTENDED ACCELERATION

TECHNICAL FIELD

The present invention relates to a throttle valve for preventing a sudden unintended acceleration, and more particularly, to a throttle valve for preventing a sudden unintended acceleration, which enables automatic closing of an air flow path without use of an additional drive source so that vehicle accidents due to a sudden unintended acceleration may be substantially prevented.

BACKGROUND ART

A throttle valve is used to control the amount of air that passes through a vaporizer or a throttle body in a vehicle. FIG. 1 illustrates a conventional throttle valve 1. The throttle valve 1 includes a valve main body 2, a flow path 8 formed in the valve main body 2 having a circular section with the center on a center line C1, (see FIG. 3) an inlet IN through which external air flows in, and an outlet OUT connected to an engine, a rotational shaft 4 rotatably coupled to the valve main body 2, a circular regulation plate 3 coupled to the rotational shaft 4 and controlling the amount of a fluid passing through the flow path 8, a lever 5 coupled to one end portion of the rotational shaft 4, a spring 7 elastically biasing the regulation plate 3 in a direction toward closing the flow path 8, and a cable 6 connected between the lever 5 and an accelerator pedal (not shown).

Accordingly, when a driver presses the accelerator pedal, the cable 6 is pulled as illustrated in FIG. 2, and the regulation plate 3 is open as illustrated in FIG. 3. When the driver does not press the accelerator pedal, the spring 7 moves the regulation plate 3 to close the flow path 8. A degree of opening of the flow path 8 by the regulation plate 3 is regulated to be proportional to a degree of the driver's pressing on the accelerator pedal.

In other words, the more the driver presses the accelerator pedal, the more the regulation plate 3 is opened, and thus, the amount of air passing through the flat path 8 increases. If the driver slightly presses the accelerator pedal, the regulation plate 3 is slightly opened, and thus, the amount of air passing through the flat path 8 decreases. When the amount of air passing through the flow path 8 increases, an electronic control unit (ECU) detects an increase in the amount of air in the flow path 8, and thus, increases an amount of fuel injected or sucked into the engine.

The occurrence of sudden unintended acceleration (SUA) accidents, which are caused as the engine rotates excessively even when the driver does not press the acceleration pedal, has recently increased. However, the conventional throttle valve 1 cannot deal with vehicle sudden unintended acceleration events.

DETAILED DESCRIPTION OF THE INVENTION

Technical Problem

The present invention provides a throttle valve for preventing a sudden unintended acceleration, the throttle valve having an improved structure which enables automatic closing of an air flow path without use of an additional drive source so that vehicle accidents due to a sudden unintended acceleration may be substantially prevented.

Technical Solution

According to an aspect of the present invention, there is provided a throttle valve for preventing a sudden unintended acceleration, the throttle valve regulating an amount of air supplied to an engine mounted on a vehicle and including a valve main body, a flow path formed in the valve main body and having an inlet through which the air flows in and an outlet connected to the engine, and a flow rate regulating unit regulating an amount of the air in the flow path by opening or closing the flow path, wherein, when a rapid pressure drop occurs at the outlet side connected to the engine, the flow rate regulating unit is pressed by a force generated due to a difference in pressure between the inlet and the outlet so as to close the flow path without use of an additional drive source.

The flow rate regulating unit includes a first regulation plate provided in the valve main body to be capable of rotating between an open position for opening one part of the flow path and a closed position for closing the one part of the flow path, and a second regulation plate provided in the valve main body to be capable of rotating between an open position for opening the other part of the flow path and a closed position for closing the other part of the flow path, and the first regulation plate and the second regulation plate are restricted by the flow path and thus maintain the closed position even when a rapid pressure drop occurs at the outlet side.

A first rotational shaft that is arranged across the flow path may be coupled to one end portion of the first regulation plate, a second rotational shaft that may be arranged across the flow path is coupled to one end portion of the second regulation plate, and the first rotational shaft and the second rotational shaft may be arranged at a center portion of the flow path to be substantially parallel to each other and to be capable of rotating with respect to the valve main body in engagement with each other.

The first regulation plate and the second regulation plate may have a symmetrical shape to close parts of the flow path having substantially the same area.

The first rotational shaft and the second rotational shaft may be engaged with each other by gears.

The throttle valve may further include a connection device connecting one end portion of the first rotational shaft to an accelerator pedal, and an elastic device elastically biasing the first regulation plate or the second regulation plate in a direction in which the first regulation plate or the second regulation plate closes the flow path.

A maximum distance between the other end portion of the first regulation plate and the other end portion of the second regulation plate may be greater than a maximum width of the flow path.

The flow rate regulating unit may include a rotational shaft arranged across the flow path and rotatably provided on the valve main body, a first regulation plate coupled to one side of the rotational shaft and rotating together with the rotational shaft to open or close one part of the flow path, and a second regulation plate coupled to the other side of the rotational shaft and rotating together with the rotational shaft to open or close the other part of the flow path, and a area of the first regulation plate is larger than a area of the second regulation plate.

The flow rate regulating unit may include a rotational shaft arranged at one lateral end portion of the flow path and rotatably provided on the valve main body, and a regulation plate coupled to the rotational shaft to be capable of rotating between an open position for opening the flow path and a closed position for closing the flow path.

In the flow path, a cross sectional area at the inlet side may be larger than a cross sectional area at the outlet side, and the flow rate regulating unit may include a regulation plate that is capable of moving between an open position adjacent to the inlet and a closed position adjacent to the outlet.

Advantageous Effects

According to the present invention, when a rapid pressure drop occurs at an outlet side connected to the engine, a flow rate regulating unit automatically closes the flow path, without use of an additional drive source, by being pressed by a force generated due to a difference in pressure between an inlet and an outlet, thereby substantially preventing a vehicle accident caused by a sudden unintended acceleration.

BEST MODE

Figure 1:
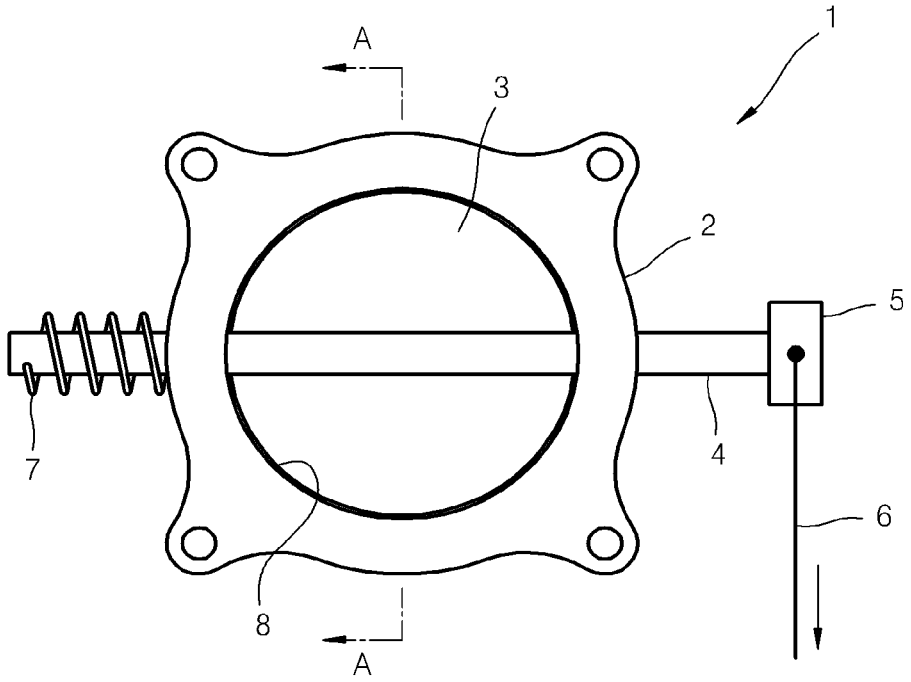
FIG. 1 (PRIOR ART)
FIG. 1 is a plan view illustrating a conventional throttle valve.
Figure 2:
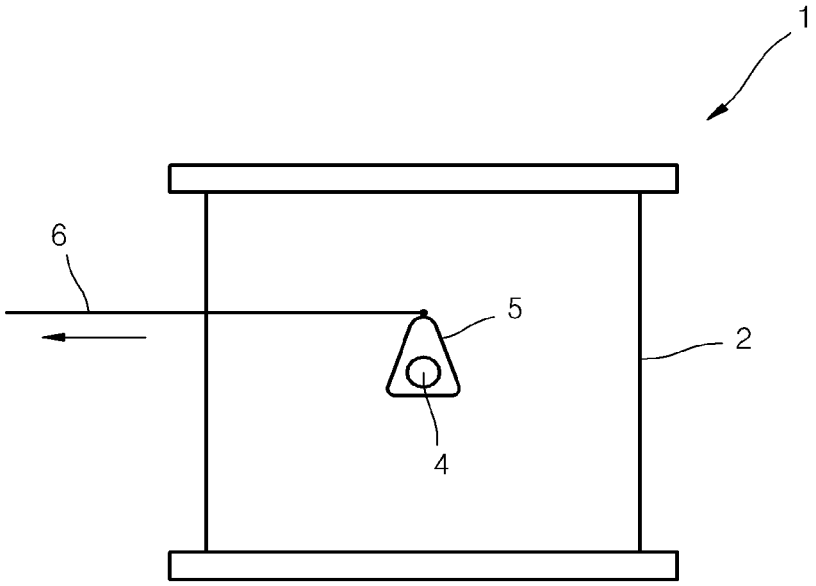
FIG. 2 (PRIOR ART)
FIG. 2 is a right side view of the throttle valve of FIG. 1.
Figure 3:
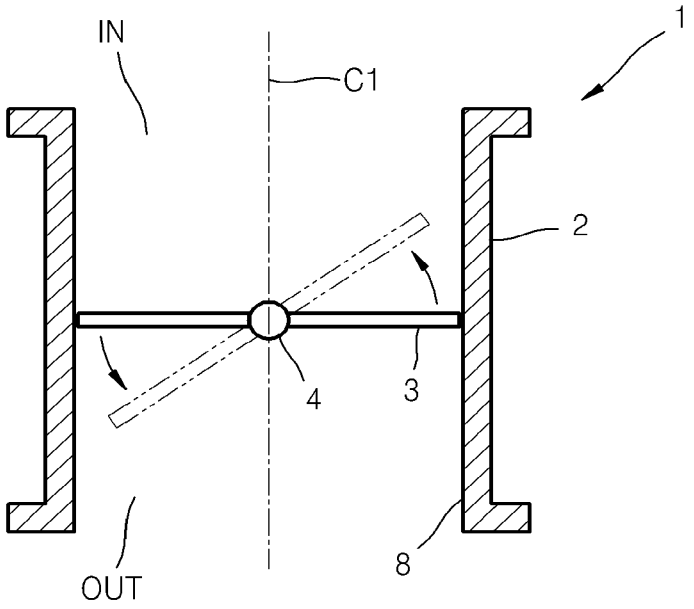
FIG. 3 (PRIOR ART)
FIG. 3 is a cross-sectional view of the throttle valve, taken along the line A-A of FIG. 1.
Figure 4:
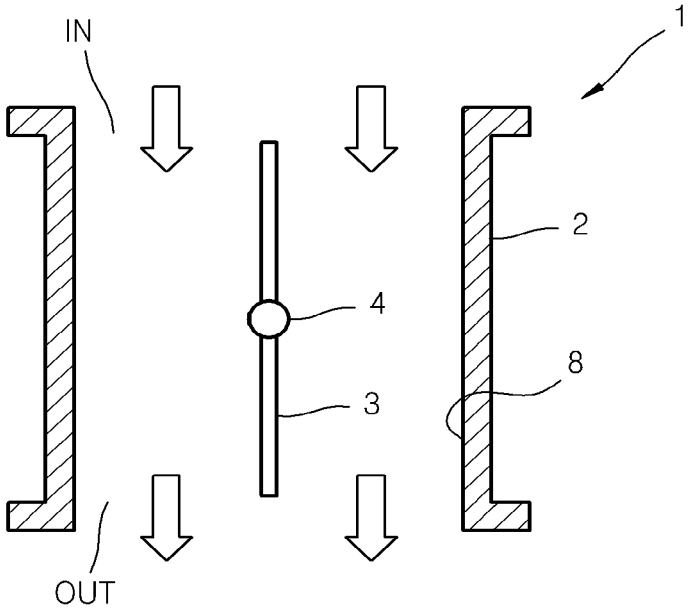
FIG. 4 (PRIOR ART)
FIG. 4 illustrates the throttle valve of FIG. 1 in a completely open state.

The present inventor suggests the following concept regarding sudden unintended acceleration (SUA) accidents. According to this concept, when fuel is excessively supplied to an engine (not shown) for a certain reason, an abnormal explosion phenomenon occurs in the engine, which creates a sort of a vacuum phenomenon occurs in the engine. The vacuum phenomenon in the engine causes a regulation plate 3 of a conventional throttle valve 1 to be completely open as illustrated in FIG. 4, even when a driver does not press an accelerator pedal (not shown). Accordingly, the amount of air in a flow path 8 is rapidly increased, and thus, an electronic control unit (ECU) detects an increase in the amount of air in the flow path 8 and issues a command to increase the amount of fuel injected or sucked into the engine. As a result, a sudden unintended acceleration accident occurs in which the engine rotates excessively.

If the above concept suggested by the present inventor is assumed to be true, complete opening of the regulation plate 3 as illustrated in FIG. 4 when a rapid pressure drop is generated at the outlet side OUT may create a problem because the regulation plate 3 in the conventional throttle valve 1 is substantially divided into two halves with respect to a rotational shaft 4, and thus, the regulation plate 3 is elastically biased in a direction to close the flow path 8 only by a feeble elastic force of the spring 7.

Thus, even when a rapid pressure drop at the outlet side OUT of the regulation plate 3 occurs, a vehicle sudden unintended acceleration accident may be prevented if a throttle valve is combined with the regulation plate 3 that is not completely open. The present invention is invented based on this conclusion.

Hereinafter, various embodiments of the present invention will be described with reference to the accompanying drawings.

Figure 5:
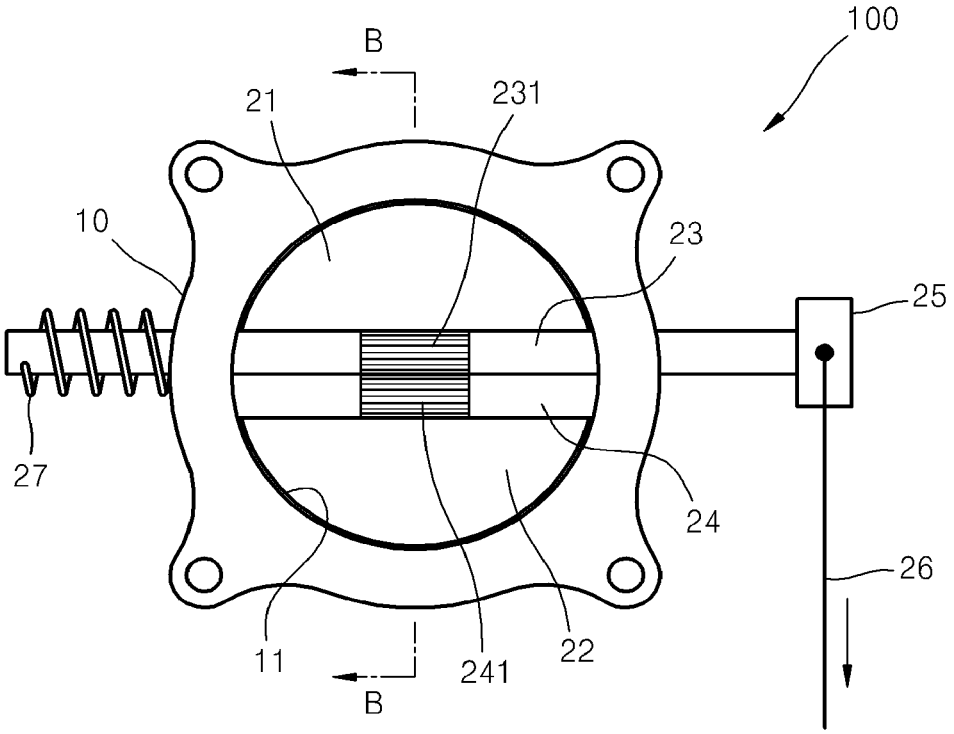
FIG. 5 is a plan view of a throttle valve for preventing a sudden unintended acceleration according to an embodiment of the present invention.
Figure 6:
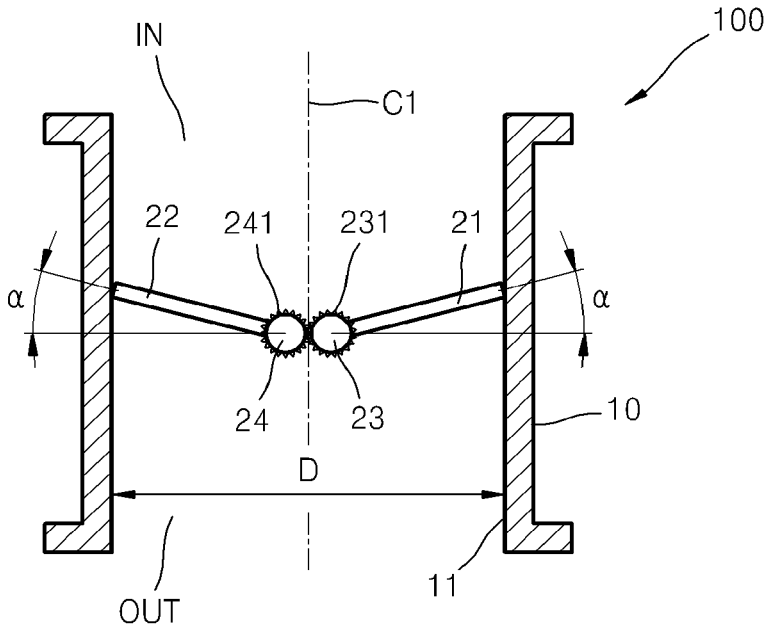
FIG. 6 is a cross-sectional view of the throttle valve for preventing a sudden unintended acceleration, taken along the line B-B of FIG. 5.
Figure 7:
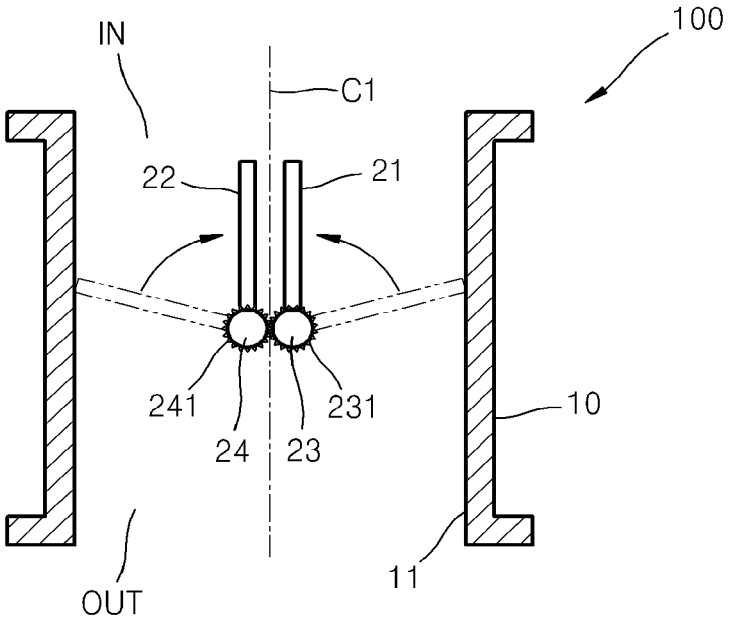
FIG. 7 illustrates the throttle valve for preventing a sudden unintended acceleration of FIG. 5 in a completely open state.

FIG. 5 is a plan view of a throttle valve 100 for preventing a sudden unintended acceleration according to an embodiment of the present invention. FIG. 6 is a cross-sectional view of the throttle valve 100 for preventing a sudden unintended acceleration, taken along the line B-B of FIG. 5. FIG. 7 illustrates the throttle valve 100 for preventing a sudden unintended acceleration of FIG. 5 in a completely open state.

Referring to FIGS. 5 to 7, the throttle valve 100 for preventing a sudden unintended acceleration regulates the amount of air supplied to an engine mounted on a vehicle and includes a valve main body 10 and a flow rate regulating unit.

The valve main body 10 is a cast-metal member and has a flow path 11 formed therein. The flow path 11 is a circular path through which air flows and includes an inlet IN and an outlet OUT as illustrated in FIG. 6. In the present embodiment, the flow path 11 has a circular section with the center on a center line C1 and has a predetermined diameter D.

The inlet IN is an entrance through which external air flows in and is formed in an upper end portion of the valve main body 10. The outlet OUT is an exit through which the input air is output to the engine and is formed in a lower end portion of the valve main body 10.

The flow rate regulating unit regulates the amount of air flowing in the flow path 11 by opening or closing the flow path 11. The flow rate regulating unit according to the present embodiment includes a first regulation plate 21, a second regulation plate 22, a first rotational shaft 23, and a second rotational shaft 24.

The first regulation plate 21 is a semicircular metal plate as illustrated in FIG. 5 and is arranged to be capable of rotating between an open position where an upper half portion of the flow path 11 is open and a closed position where the upper half portion of the flow path 11 is closed.

The second regulation plate 22 is a semicircular metal plate as illustrated in FIG. 5 and is arranged to be capable of rotating between an open position where a lower half portion of the flow path 11 is open and a closed position where the lower half portion of the flow path 11 is closed.

In the present embodiment, the first regulation plate 21 and the second regulation plate 22 have a symmetrical shape so as to close parts of the flow path 11 having substantially the same area at the closed position.

The first rotational shaft 23 is a lengthy circular rod member arranged across the center portion of the flow path 11 and has opposite end portions rotatably provided with respect to the valve main body 10. One end portion of the first regulation plate 21 is rotationally fixed to the center portion of the first rotational shaft 23. A first gear 231 is formed around the center portion of the first rotational shaft 23.

The second rotational shaft 24 is a lengthy circular rod member arranged across the center portion of the flow path 11 and has opposite end portions rotatably provided with respect to the valve main body 10. One end portion of the second regulation plate 22 is rotationally fixed to the center portion of the second rotational shaft 24. A second gear 241 is formed around the center portion of the second rotational shaft 24.

The second gear 241 is coupled to the first gear 231 as illustrated in FIG. 6, and thus, the first and second rotational shafts 21 and 22 are engaged with each other by gears.

As illustrated in FIG. 6, when the first rotational shaft 23 rotates clockwise, the second rotational shaft 24 rotates counterclockwise. Also, when the first rotational shaft 23 rotates counterclockwise, the second rotational shaft 24 rotates clockwise.

In the present embodiment, the first and second rotational shafts 21 and 22 are arranged substantially parallel to the center portion of the flow path 22 to be close to each other.

Figure 8:
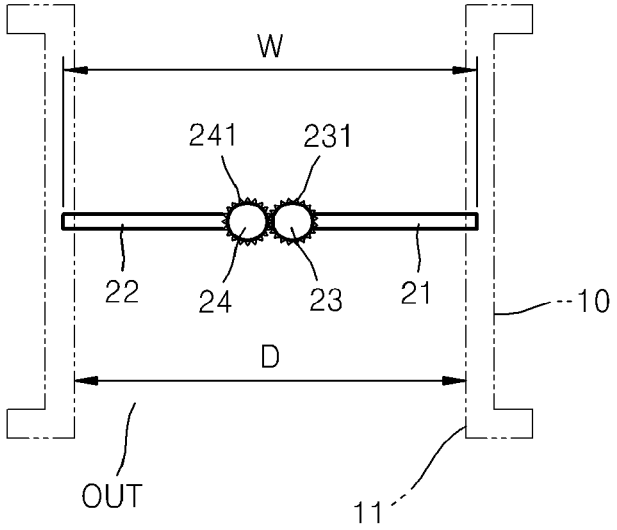
FIG. 8 explains the maximum width of the first regulating plate and a second regulating plate of the throttle valve for preventing a sudden unintended acceleration of FIG. 5.

In the present embodiment, as illustrated in FIG. 8, the maximum width W between the other end portion of the first regulation plate 21 and the other end portion of the second regulation plate 22 is larger than the maximum width D of the flow path 11. When both of the first and second regulation plates 21 and 22 are in the closed positions as illustrated in FIG. 6, the first and second regulation plates 21 and 22 are arranged to be rotated toward the outlet W by a predetermined angle $\alpha$.

Accordingly, the other end portion of the first regulation plate 21 and the other end portion of the second regulation plate 22 are restricted by the flow path 11. When a rapid pressure drop occurs at the outlet side OUT, the first and second regulation plates 21 and 22 are not rotated toward the outlet OUT and may be maintained in the closed positions.

A connection unit (not shown) to connect the first rotational shaft 23 to the accelerator pedal is provided at one end portion of the first rotational shaft 23. The connection unit includes a lever 25 and a cable 26. As illustrated in FIG. 5, the lever 25 is a member having one end portion fixedly coupled to the first rotational shaft 23 and other end portion protruding in a radial direction of the first rotational shaft 23. The cable 26 is a metal wire member and has one end portion connected to the accelerator pedal and other end portion connected to the other end portion of the lever 25.

A spring 27 is provided as an elastic member at the other end portion of the first rotational shaft 23 to elastically bias the first rotational shaft 23. The spring 27 is a coil spring that elastically biases the first rotational shaft 23 in a direction in which the first regulation plate 21 closes the flow path 11. The spring 27 has one end portion coupled to the other end portion of the first rotational shaft 23 and other end portion coupled to the valve main body 10. The spring 27 applies a twist momentum to the first rotational shaft 23 so that the first regulation plate 21 may always close the flow path 11 when there is no external force.

A method of using the throttle valve 100 for preventing a sudden unintended acceleration configured as above will be described below.

First, when a driver presses the accelerator pedal, as illustrated in FIG. 5, the cable 26 is pulled and thus the lever 25 and the first rotational shaft 23 rotate altogether. As the second rotational shaft 24 engaged with the first rotational shaft 23 rotates, the first regulation plate 21 and the second regulation plate 22 are rotated to the open positions as illustrated in FIG. 7. In doing so, a degree of opening of the flow path 11 by the first regulation plate 21 and the second regulation plate 22 is regulated to be proportional to a degree of the driver's pressing the accelerator pedal.

When the driver releases the accelerator pedal in the state where the first regulation plate 21 and the second regulation plate 22 are disposed in the open positions, the first rotational shaft 23 and the second rotational shaft 24 are rotated in engagement with each other, and thus, both of the first regulation plate 21 and the second regulation plate 22 are rotated to the closed positions.

On the other hand, in the state where the first regulation plate 21 and the second regulation plate 22 open the flow path 11 to some degree, when a rapid pressure drop occurs at the outlet side OUT that is connected to the engine, the first regulation plate 21 and the second regulation plate 22 are pressed by a force generated due to a difference in pressure between the inlet IN and the outlet OUT. Accordingly, the first regulation plate 21 and the second regulation plate 22 are rotated to the closed positions, and thus, the flow path 11 is automatically completely closed without use of an additional drive source. The force generated due to the pressure drop is generally quite greater than a pressure applied to the accelerator pedal by the driver.

As such, when the first regulation plate 21 and the second regulation plate 22 are rotated to the closed positions, as illustrated in FIG. 6, the other end portion of the first regulation plate 21 and the other end portion of the second regulation plate 22 are not rotated further toward the outlet OUT and may be maintained in the closed positioned.

When the flow path 11 is closed, and thus, the supply of air to the engine is blocked, even when a large amount of fuel is supplied into the engine, an explosion phenomenon due to mixing of the fuel and air may not occur, thereby substantially preventing sudden unintended acceleration accidents.

The throttle valve 100 for preventing a sudden unintended acceleration configured as above includes the flow rate regulating unit that regulates the amount of air in the flow path 11 by opening or closing the flow path 11. When a rapid pressure drop occurs at the outlet side OUT that is connected to the engine, the flow rate regulating unit that is pressed by the force generated due to a difference in pressure between the inlet IN and the outlet OUT automatically closes the flow path 11 so that a vehicle sudden unintended acceleration accident may be substantially prevented.

In the throttle valve 100 for preventing a sudden unintended acceleration according to the present embodiment, the flow rate regulating unit includes the first regulation plate 21 and the second regulation plate 22 that are capable of rotating between the open position and the closed position. Since the first and second regulation plates 21 and 22 are restricted by an inner circumferential surface of the flow path 11, even when a rapid pressure drop occurs at the output OUT, the first and second regulation plates 21 and 22 may maintain the closed position.

Also, in the throttle valve 100 for preventing a sudden unintended acceleration according to the present embodiment, the first rotational shaft 23 that is arranged across the flow path 11 is coupled to one end portion of the first regulation plate 21, and the second rotational shaft 23 that is arranged across the flow path 11 is coupled to one end portion of the second regulation plate 22. The first and second rotational shafts 23 and 24 are substantially parallelly arranged at the center portion of the flow path 11 to be capable of relatively rotating with respect to the valve main body 10. Also, since the first and second rotational shafts 23 and 24 are engaged with each other by gears to be capable of rotating together, if only one of the first and second rotational shafts 23 and 24 is rotated, the other one may be rotated accordingly.

In the throttle valve 100 for preventing a sudden unintended acceleration according to the present embodiment, since the first and second regulation plates 21 and 22 have a symmetrical shape to close parts of the flow path 11 having substantially the same area, the air flowing in the flow path 11 may have a pneumatically stable flow when the first and second regulation plates 21 and 22 are open. Also, the first and second rotational shafts 23 and 24 may be rotated in engagement with each other.

Also, in the throttle valve 100 for preventing a sudden unintended acceleration according to the present embodiment, since the first and second rotational shafts 23 and 24 are engaged with each other by gears, an engagement structure is simple compared to other engagement devices and a strong rotational force may be transferred without a sliding motion between the first and second rotational shafts 23 and 24.

The throttle valve 100 for preventing a sudden unintended acceleration includes a connection device connecting one end portion of the first rotational shaft 23 and the accelerator pedal and the spring 27 for elastically biasing the first regulation plate 21 in a direction to close the flow path 11. Accordingly, when the driver releases the accelerator pedal, both of the first and second regulation plates 21 and 22 are rotated toward the closed positions due to the elastic force of the spring 27.

Figure 9:
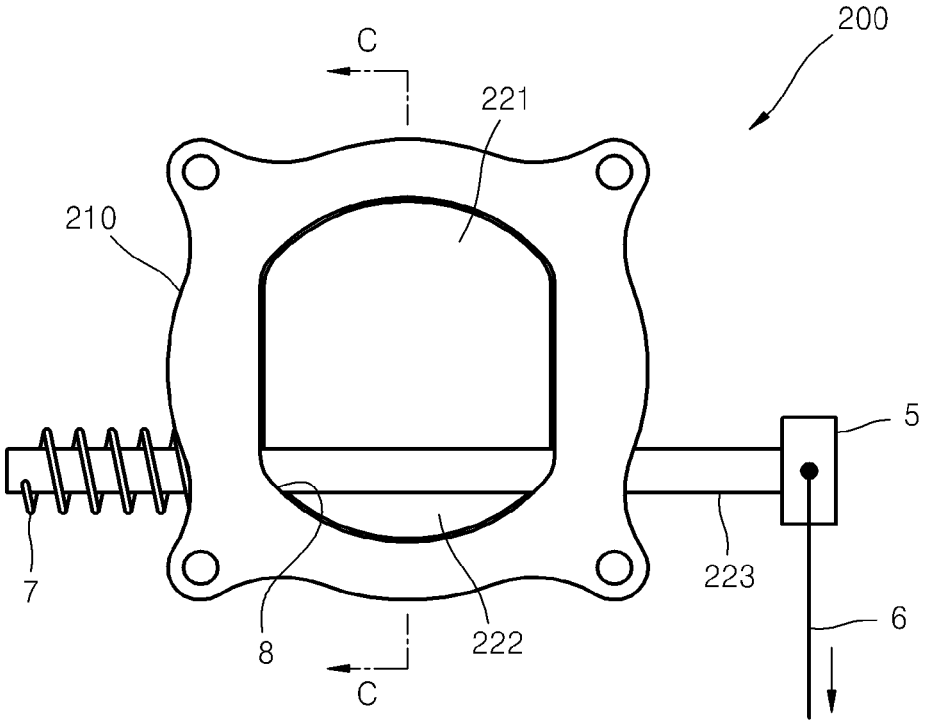
FIG. 9 is a plan view of a throttle valve for preventing a sudden unintended acceleration according to another embodiment of the present invention.

FIG. 9 is a plan view of a throttle valve 200 for preventing a sudden unintended acceleration according to another embodiment of the present invention. Since most constituent elements of the throttle valve 200 for preventing a sudden unintended acceleration according to the present embodiment and the above-described throttle valve 100 for preventing a sudden unintended acceleration are identical, only differences therebetween will be discussed below.

Referring to FIG. 9, a flow rate regulating unit of the throttle valve 200 for preventing a sudden unintended acceleration according to the present embodiment includes a first regulation plate 221, a second regulation plate 222, and a rotational shaft 223. The rotational shaft 223 is arranged across a flow path 8 and is rotatably provided on a valve main body 210. In the present embodiment, the rotational shaft 223 is arranged across the middle portion of a lower half portion of the flow path 8 as illustrated in FIG. 9.

The first regulation plate 221 is a metal plate member as illustrated in FIG. 9 and is arranged to be capable of rotating between an open position for opening an upper portion of the flow path 8 and a closed position for closing an upper portion of the flow path 8. One end portion of the first regulating plate 221 is coupled to an upper side of a middle portion of the rotational shaft 223 so that the first regulating plate 221 may be rotated together with the rotational shaft 223.

The opposite side end portions of the first regulating plate 221 and the flow path 8 have linear forms. Accordingly, as illustrated in FIG. 10, the first regulating plate 221 may smoothly rotate between the open position and the closed position without an interruption by the flow path 8.

The second regulation plate 222 is a semicircular metal member as illustrated in FIG. 9 and is arranged to be capable of rotating between an open position for opening a lower portion of the flow path 8 and a closed position for closing a lower portion of the flow path 8. One end portion of the second regulating plate 222 is coupled to a lower side of the middle portion of the rotational shaft 223 so that the second regulating plate 222 may be rotated together with the rotational shaft 223. The second regulation plate 222 is rotated in the opposite direction to the first regulation plate 221. In the present embodiment, the size of the first regulation plate 221 is larger than the size of the second regulation plate 222, for example, about 8 to 10 times larger than the size of the second regulation plate 222.

Figure 10:
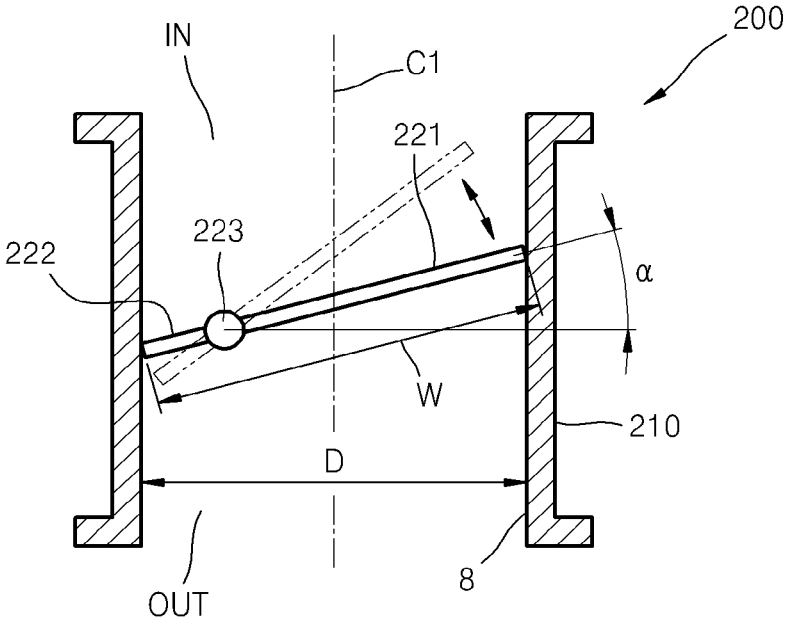
FIG. 10 is a cross-sectional view of the throttle valve for preventing a sudden unintended acceleration, taken along the line C-C of FIG. 9.

In the throttle valve 200 for preventing a sudden unintended acceleration according to the present embodiment as illustrated in FIG. 10, when an abnormal explosion occurs in the engine and thus a rapid pressure drop occurs at the outlet side OUT that is connected to the engine in a state where the first regulation plate 221 and the second regulation plate 222 open the flow path 8 to some degree, the first regulation plate 21 and the second regulation plate 22 are pressed by a force generated due to a difference in pressure between the inlet IN and the outlet OUT.

However, in the throttle valve 200 for preventing a sudden unintended acceleration according to the present embodiment, since the size of the first regulation plate 221 is larger than that of the second regulation plate 222, if the same pressure is applied, a force applied to the first regulation plate 221 is relatively larger than that applied to the second regulation plate 222, and thus, the flow path 8 may be automatically completely closed without use of an additional drive source. In doing so, the other end portion of the first regulation plate 221 and the other end portion of the second regulation plate 222 are restricted by the flow path 8 and thus the first and second regulation plates 221 and 222 may not be further rotated.

According to the throttle valve 200 for preventing a sudden unintended acceleration according to the present embodiment, since there is not much structural difference from the conventional throttle valve 1, most parts of the conventional throttle valve 1 may be used and thus manufacturing costs are low and manufacturing of the throttle valve 200 is easy.

Figure 11:
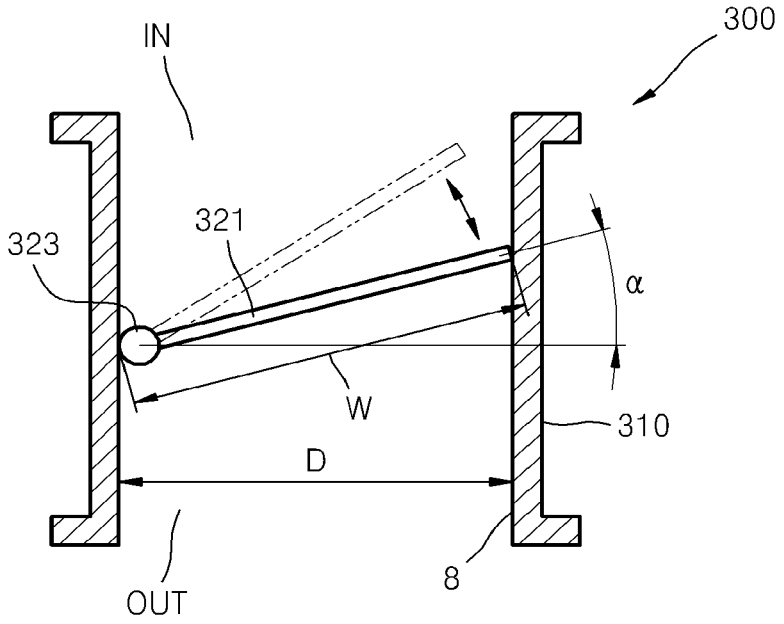
FIG. 11 is a cross-sectional view of a throttle valve for preventing a sudden unintended acceleration according to another embodiment of the present invention.

FIG. 11 is a cross-sectional view of a throttle valve 300 for preventing a sudden unintended acceleration according to another embodiment of the present invention. Since most constituent elements of the throttle valve 300 for preventing a sudden unintended acceleration according to the present embodiment and the above-described throttle valve 200 for preventing a sudden unintended acceleration are identical, only differences therebetween will be discussed below.

The throttle valve 300 for preventing a sudden unintended acceleration according to the present embodiment includes, instead of the second regulation plate 222, a rotational shaft 323 that is rotatably provided at one side end portion of the inner circumferential surface of the flow path 8 and a regulation plate 321 that is rotatably coupled to the rotational shaft 223 to rotate between an open position for opening the flow path 8 and a closed position for closing the flow path 8.

The throttle valve 300 for preventing a sudden unintended acceleration according to the present embodiment has a simpler structure compared to the throttle valve 200 for a preventing sudden unintended acceleration. When a rapid pressure drop occurs at the outlet side OUT, only the regulation plate 321 is pressed so that the flow path 8 may be surely and rapidly closed.

Figure 12:
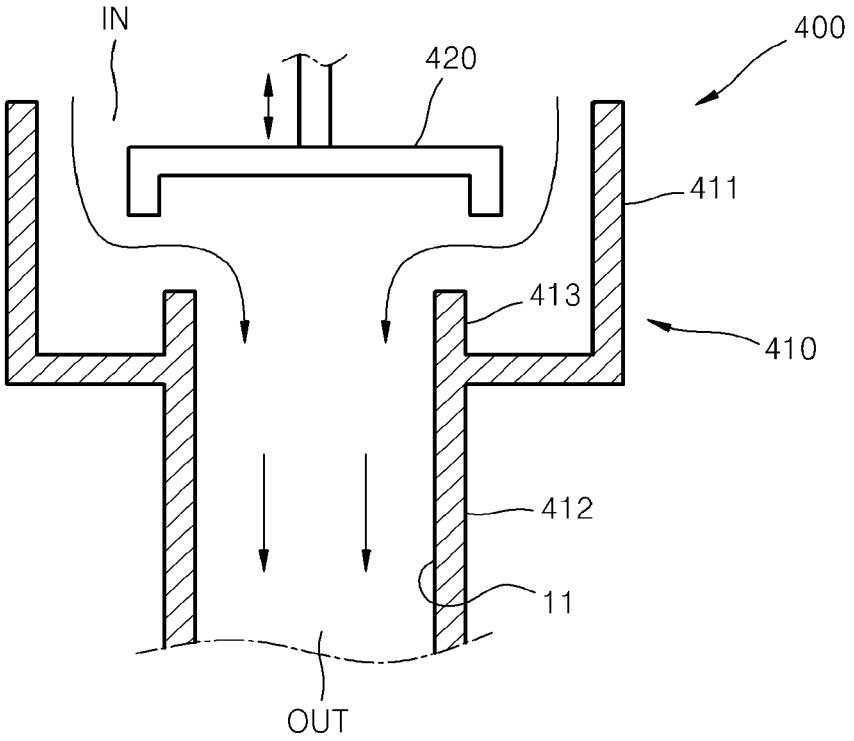
FIG. 12 is a cross-sectional view of a throttle valve for preventing a sudden unintended acceleration according to another embodiment of the present invention.

FIG. 12 is a cross-sectional view of a throttle valve 400 for preventing a sudden unintended acceleration according to another embodiment of the present invention. Referring to FIG. 12, the throttle valve 400 for preventing a sudden unintended acceleration according to the present embodiment includes a valve main body 410 and a regulation plate 420.

The valve main body 410 is a cast-metal member and includes an upper main body 411 and a lower main body 412. The upper main body 411 includes an inlet IN having a diameter large enough to accommodate the regulation plate 420. The lower main body 412 includes an outlet OUT having a diameter smaller than that of the outlet OUT, and is connected to a lower end portion of the upper main body 411. In the present embodiment, a cross-sectional area of the inlet IN is larger than a cross-sectional area of the outlet OUT.

A protruding portion 413 is formed in an upper end portion of the lower main body 412 to protrude upwardly from the bottom of the upper main body 411. The regulation plate 420 is a circular plate member and is capable of vertically moving (OK) between an open position adjacent to the inlet IN and a closed position adjacent to the outlet OUT.

Figure 13:
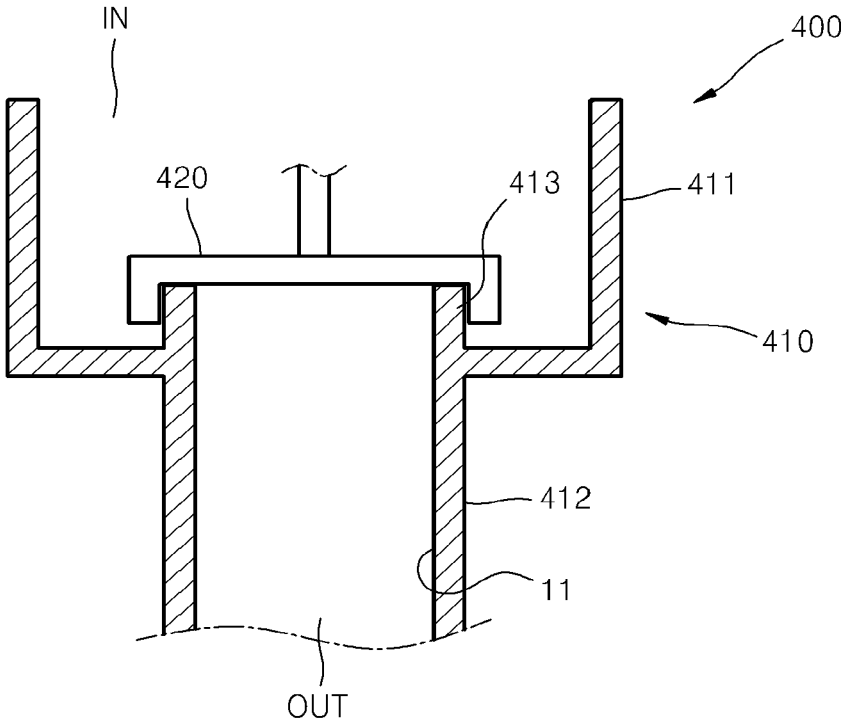
FIG. 13 illustrates the throttle valve for preventing a sudden unintended acceleration of FIG. 12 in a completely closed state.

When the driver presses the acceleration pedal, the regulation plate 420 ascends to the open position. When the driver releases the acceleration pedal, the regulation plate 420 descends to the closed position. As illustrated in FIG. 13, the regulation plate 420 at the closed position closes the flow path 11 by encompassing the outer circumferential surface of the upper end portion of the protruding portion 413. Accordingly, since the regulation plate 420 is restricted by the protruding portion 413, the regulation plate 420 no longer descends.

In the throttle valve 400 for preventing a sudden unintended acceleration according to the present embodiment, when a rapid pressure drop occurs at the outlet side OUT that is connected to the engine due to an abnormal explosion phenomenon in the engine, the regulation plate 420 is pressed by a force generated due to a difference in pressure between the inlet IN and the outlet OUT. Accordingly, the flow path 11 is automatically completely closed without use of an additional drive source.

The throttle valve 400 for preventing a sudden unintended acceleration according to the present embodiment is different from the throttle valves 100, 200, and 300 for preventing a sudden unintended acceleration in that the throttle valve 400 includes the regulation plate 420 that is capable of vertically moving.

Figure 14:
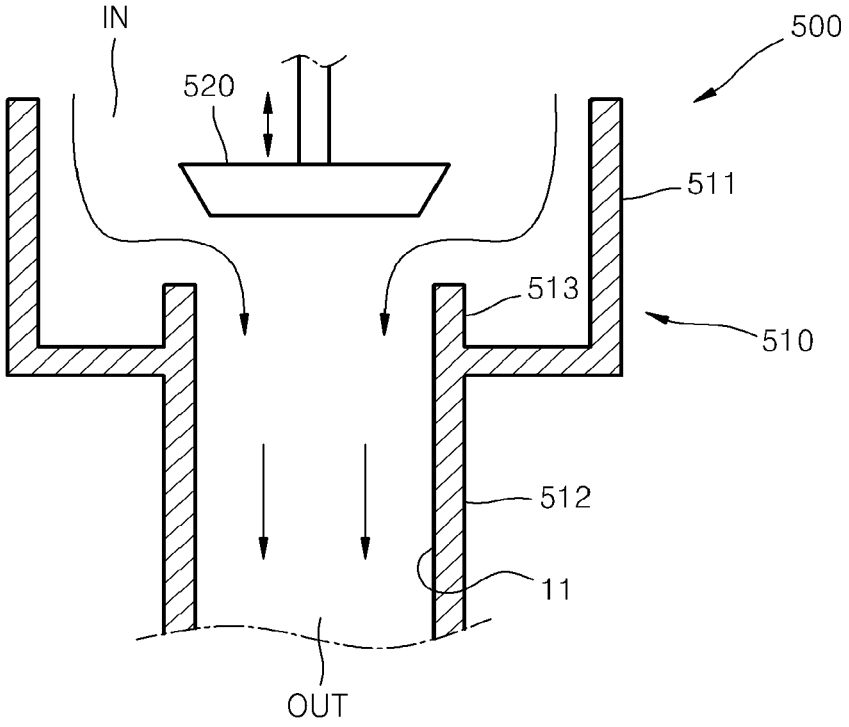
FIG. 14 is a cross-sectional view of a throttle valve for preventing a sudden unintended acceleration according to another embodiment of the present invention.

FIG. 14 illustrates a throttle valve 500 for preventing a sudden unintended acceleration according to another embodiment of the present invention. Since the structure of the throttle valve 500 for preventing a sudden unintended acceleration according to the present embodiment is substantially the same as that of the throttle valve 400 for preventing a sudden unintended acceleration, only differences therebetween will be discussed below.

The throttle valve 500 for preventing a sudden unintended acceleration according to the present embodiment includes a regulation plate 520 that is a circular plate member and is capable of vertically moving between an open position adjacent to the inlet IN and a closed position adjacent to the outlet OUT.

Figure 15:
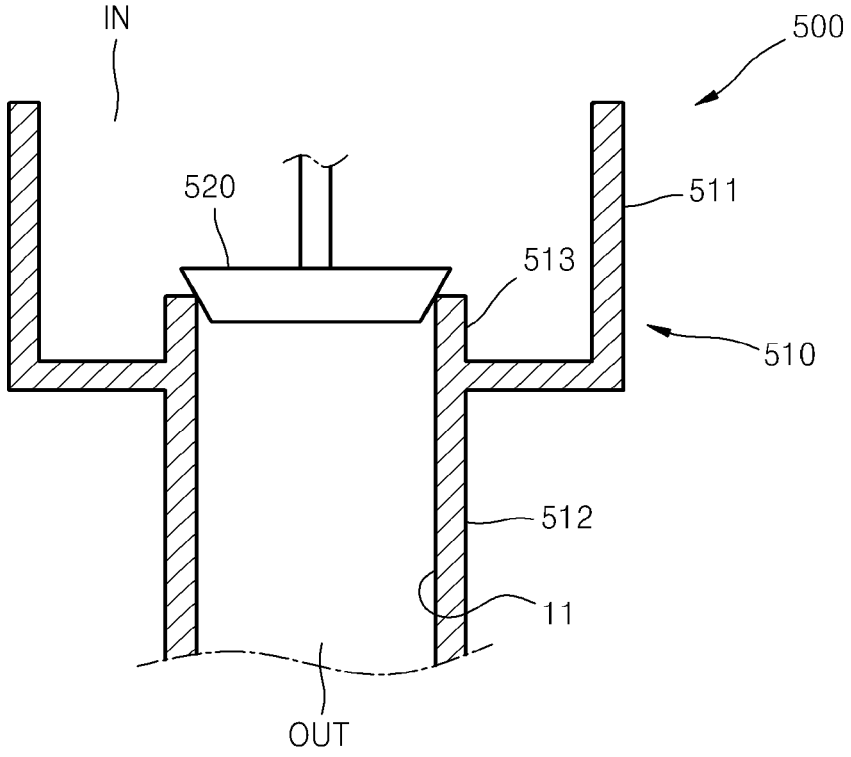
FIG. 15 illustrates the throttle valve for preventing a sudden unintended acceleration of FIG. 14 in a completely closed state.

When the regulation plate 520 is inserted into a lower main body 512 to contact an inner circumferential surface of an upper end portion of a protruding portion 513 as illustrated in FIG. 15, the regulation plate 520 in the closed position is restricted by the protruding portion 513 and thus no longer descends.

As such, the throttle valve 500 for preventing a sudden unintended acceleration according to the present embodiment closes the flow path 11 with the regulation plate 520 contacting the inner circumferential surface of the upper end portion of the protruding portion 513. Thus, the regulation plate 520 may be fixed to the protruding portion 513 without moving in the closed position.

While this invention has been particularly shown and described with reference to exemplary embodiments thereof, it will be understood by those skilled in the art that various changes in form and details may be made therein without departing from the spirit and scope of the invention as defined by the appended claims.

The invention claimed is:

1. A throttle valve for preventing a sudden unintended acceleration, the throttle valve regulating an amount of air supplied to an engine mounted on a vehicle and comprising:

a valve main body;

a flow path formed in the valve main body and having an inlet through which the air flows in and an outlet connected to the engine; and a flow rate regulating unit regulating an amount of the air in the flow path by opening or closing the flow path, wherein, when a rapid pressure drop occurs at the outlet side connected to the engine, the flow rate regulating unit is pressed by a force generated due to a difference in pressure between the inlet and the outlet so as to close the flow path, wherein the flow rate regulating unit comprises:

a first regulation plate provided in the valve main body to be capable of rotating between an open position for opening one part of the flow path and a closed position for closing the one part of the flow path; and a second regulation plate provided in the valve main body to be capable of rotating between an open position for opening the other part of the flow path and a closed position for closing the other part of the flow path, wherein the first regulation plate and the second regulation plate are restricted by the flow path and thus maintain the closed position even when a rapid pressure drop occurs at the outlet side, wherein a first rotational shaft that is arranged across the flow path is coupled to one end portion of the first regulation plate, a second rotational shaft that is arranged across the flow path is coupled to one end portion of the second regulation plate, and the first rotational shaft and the second rotational shaft are arranged at a center portion of the flow path to be substantially parallel to each other and to be capable of rotating with respect to the valve main body in engagement with each other, and wherein a maximum distance between the other end portion of the first regulation plate and the other end portion of the second regulation plate is greater than a maximum width of the flow path.

2. The throttle valve of claim 1, wherein the first regulation plate and the second regulation plate have a symmetrical shape to close parts of the flow path having substantially the same area.

3. The throttle valve of claim 1, wherein the first rotational shaft and the second rotational shaft are engaged with each other by gears.

4. The throttle valve of claim 1, further comprising:

a connection device connecting one end portion of the first rotational shaft to an accelerator pedal; and an elastic device elastically biasing the first regulation plate or the second regulation plate in a direction in which the first regulation plate or the second regulation plate closes the flow path.

5. The throttle valve of claim 1, wherein the flow rate regulating unit comprises:

a rotational shaft arranged across the flow path and rotatably provided on the valve main body;

a first regulation plate coupled to one side of the rotational shaft and rotating together with the rotational shaft to open or close one part of the flow path; and a second regulation plate coupled to the other side of the rotational shaft and rotating together with the rotational shaft to open or close the other part of the flow path, and an area of the first regulation plate is larger than an area of the second regulation plate.

6. The throttle valve of claim 1, wherein the flow rate regulating unit comprises:

a rotational shaft arranged at one lateral end portion of the flow path and rotatably provided on the valve main body; and a regulation plate coupled to the rotational shaft to be capable of rotating between an open position for opening the flow path and a closed position for closing the flow path.

7. The throttle valve of claim 1, wherein, in the flow path, a cross sectional area at the inlet side is larger than a cross sectional area at the outlet side, and the flow rate regulating unit comprises a regulation plate that is capable of moving between an open position adjacent to the inlet and a closed position adjacent to the outlet.

* * * * *